US009728042B1

(12) United States Patent
Setzman

(10) Patent No.: US 9,728,042 B1
(45) **Date of Patent: *Aug. 8, 2017**

(54) WAGERING ON EVENT WITH RANDOM WINNING CONDITION

(71) Applicant: Dan Setzman, New York, NY (US)

(72) Inventor: Dan Setzman, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/746,837

(22) Filed: Jun. 22, 2015

Related U.S. Application Data

(63) Continuation of application No. 13/406,310, filed on Feb. 27, 2012, now Pat. No. 9,076,304.

(51) Int. Cl.
*A63F 9/24* (2006.01)
*G07F 17/32* (2006.01)

(52) U.S. Cl.
CPC ..... *G07F 17/3258* (2013.01); *G07F 17/3262* (2013.01); *G07F 17/3288* (2013.01); *G07F 17/3244* (2013.01)

(58) Field of Classification Search
CPC ..... G07F 17/3244; G07F 17/3288; G07F 17/3267; G07F 17/3239; G07F 17/326; G07F 17/3202; G07F 17/3209; G07F 17/323
See application file for complete search history.

(56) References Cited

U.S. PATENT DOCUMENTS

2008/0214290 A1* 9/2008 Lee ..... G07F 17/3288 463/25

* cited by examiner

*Primary Examiner* — Justin Myhr
(74) *Attorney, Agent, or Firm* — Muskin & Farmer LLC

(57) ABSTRACT

A method, apparatus, and computer readable storage medium to implement a wagering paradigm in which a player can place a wager amount to wager on a random potential outcome of a series chosen randomly by a computer. The series can be a sporting event such as the World Series, and the random potential outcome can be an electronically randomly picked team. If the randomly picked team turns out to be the actual team that wins the World Series, then the wager would win. The payout on a winning wager can be determined using a number of algorithms, for example each possible team is given an equal payout. The wager can be placed before the series begins, during the series (e.g., after at least one game has been played or has been started), and even after the series has ended.

6 Claims, 5 Drawing Sheets

300~

LOST WAGES CASINO $100 WAGER
ON RANDOM TEAM TO WIN WORLD SERIES

RANDOM TEAM = METS
PAYOUT = 29:1
PAYS $3,000
Date: August 4,2012 ticket # 023432

300~

LOST WAGES CASINO $100 WAGER
ON RANDOM TEAM TO WIN WORLD SERIES

RANDOM TEAM = METS
PAYOUT = 29:1
PAYS $3,000
Date: August 4,2012

II III II I I IIII III I ticket # 023432

FIGURE 3A

301~

LOST WAGER ONLINE CASINO

Wager Confirmation Screen:

| | |
|---|---|
| Name: | Joe Smith |
| Amount bet: | $100 |
| Random team picked: | METS |
| Payout odds: | 29:1 |
| Payout amount: | $3,000 |
| Date: | Aug. 4, 2012 |
| Confirmation #: | 023432 |

FIGURE 3B

WAGERING ON EVENT WITH RANDOM WINNING CONDITION

Application Ser. No. 13/406,310 is incorporated by reference herein in its entirety.

BACKGROUND OF THE INVENTION

Field of the Invention

The present general inventive concept is directed to a method, apparatus, and computer readable storage medium directed to implementing a type of wager with a random winning condition.

Description of the Related Art

Betting on sports and other events is well known in the art. Typically, a player picks a predicted team he or she believes will win a game and places a wager at a casino sports book that that team will win, which will be paid at predetermined odds. Betting on a series or season outcome is also well known in the art. For example, before the baseball season begins, a player can place a proposition wager that his or her predicted team will win the World Series. Typically, such proposition wagers are placed before the season begins, although it is possible to place such a proposition wager after the series has begun. The payouts on such wagers can be determined either by professional odds-makers or "pari-mutuelly", that is, they can be based on "supply and demand" so that the casino would ideally make a profit.

What is needed is a new wagering paradigm wherein payouts can be determined in a different manner than the standard determinations.

SUMMARY OF THE INVENTION

It is an aspect of the present invention to provide a new wagering method.

The above aspects can be obtained by a method that performs (a) receiving a wager amount from a player on the series; (b) determining, using a digital computer, a pick comprising a random potential outcome of the series; (c) issuing the player an entry that is configured to win when an actual outcome of the series matches the random potential outcome; and (d) after the series is completed, paying the player a payout when the actual outcome of the series matches the random potential outcome.

The above aspects can also be obtained by an apparatus that includes at least one processor configured to execute computer readable instructions that perform: (a) receive a wager amount placed by a player; (b) determine a pick comprising a random potential outcome of the series; (c) generate an entry indicating to the player the random potential outcome; (d) generate an electronic record for the entry comprising data representing the wager amount and the random potential outcome; (e) award a payout for the entry after the series is completed only when the random potential outcome matches an actual outcome of the series; and (f) a digital storage medium operationally connected to the at least one processor.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 3A is a drawing illustrating an example paper entry, according to an embodiment;

FIG. 3B is a drawing illustrating an example of a computer entry, according to an embodiment;

DESCRIPTION OF THE PREFERRED EMBODIMENTS

Figure 1:
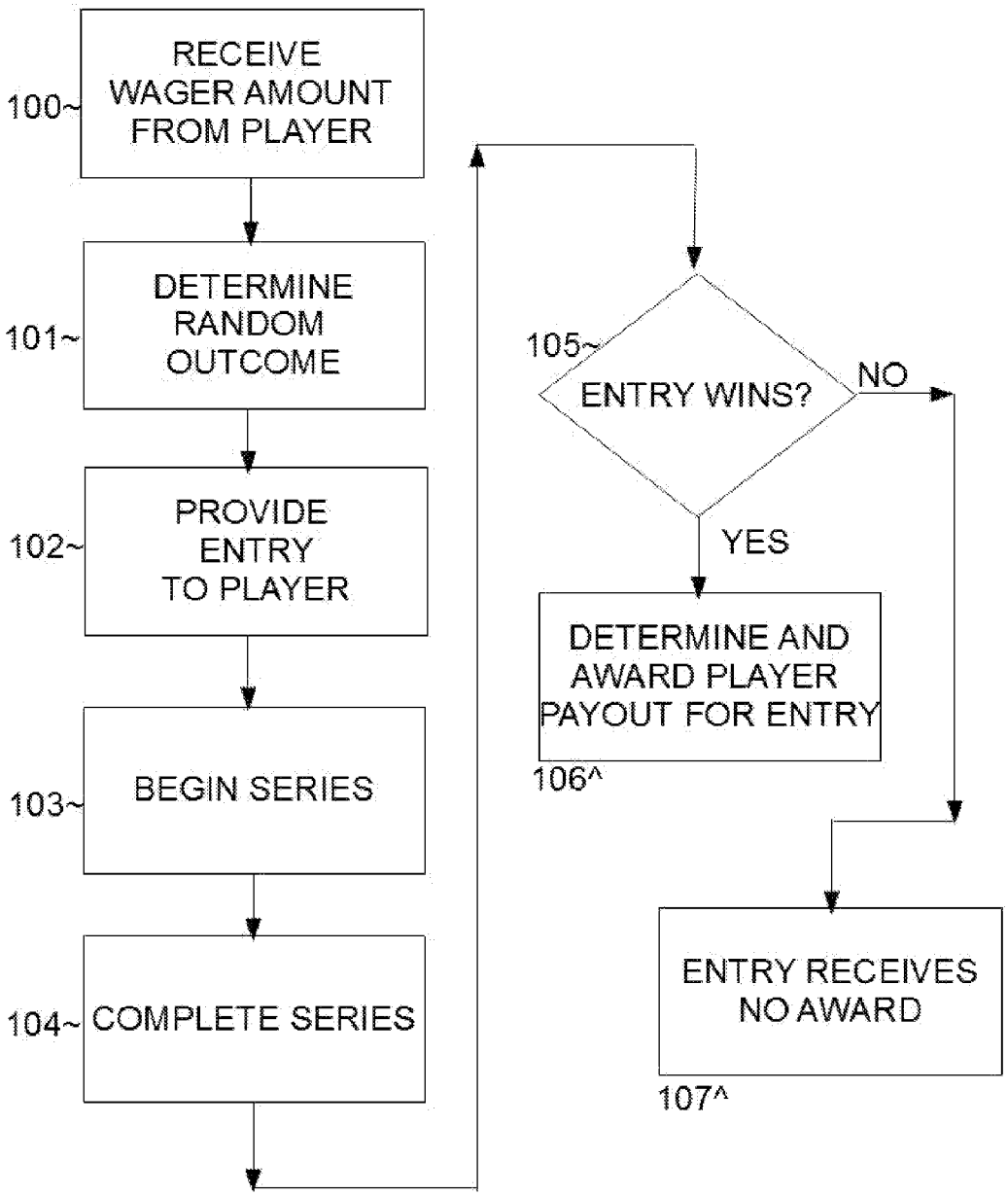
FIG. 1 is a flowchart illustrating an exemplary method of implementing a wagering paradigm before a series has begun, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a wagering paradigm wherein a player can place a desired wager amount on a wager on a pick to be determined randomly.

For example, a player can walk into a sports book and decide to wager $100 (or any amount of the player's choice) on a random potential outcome of a particular series (e.g., the World Series, Super Bowl, etc.). The player would typically know how many potential winning outcomes (how many teams in the series). The sports book would take the players $100 and use a computer to randomly generate a pick (e.g., a particular team) and give the player an entry (e.g., a slip of paper/ticket evidencing the wager). If pick (the particular team that the computer randomly picked) ends up winning the overall series (must be the overall winner, not second place), then the entry would be a winner, but if the pick does not winning the overall series in first place then the entry would be a loser. The pick is determined purely randomly, for example if there are twenty potential teams then each team has an equal chance of being randomly chosen (e.g., one in twenty chance). Thus, if 100 such wagers were made, it would be theoretically possible (but unlikely) that the same team would be picked all 100 times.

The payouts for such a wager can be determined in a number of ways. In one embodiment, the payout for each different potential team in the series would have an equal payout. For example, if there are twenty possible teams, then (without any house advantage), the payout for each team winning would be 19:1 (a $1 bet wins $19 profit plus the original $1 back). If the house wishes to incorporate a house advantage, then the payout for each winning team can be reduced (e.g., 18:1). Thus, even if the pick (which comprises the randomly selected team) were an underdog team, the payout for it winning would be the same as if the pick were a favorite team. One formula that can be used to determine the payout is:

$$\text{payout}=n*C*(1-h),$$ wherein $n$=number of possible outcomes, $C$ is the cost of the ticket, and $h$ is the house edge (advantage).

For example, if there are 10 possible outcomes, and the house has a house advantage of 0.10 (10%) and a $1 wager is made, the payout will be 10*$1*0.9=$9 (or 9:1).

Because the player does not choose the pick (the team which if wins would earn a payout), this allows for some betting opportunities that may not be present if the player was to choose the pick. For example, the wager can be made after the series has begun. Typically, bets are not commonly placed after the series has begun because some teams may be ahead of other teams thus requiring a different payouts structure (which is not always easily generated in real time). The wager can even be made after the series is over (and the player can also receive his or her payout immediately).

Series as used herein can refer to a set of games which are organized with predefined rules with an adjudicating authority so that there is ultimately only one winner (e.g., World Series, Super Bowl, Stanley Cup, etc.) For example, a set of 20 teams can each play all other teams in the set and the team with the highest winning record could be considered the winner. Once the first game of any of these series' begins, then the series is considered to have begun. In another embodiment, a series can be just a single one game and the pick is one of the two (or more) teams participating in the single game (e.g., a single baseball game). A series can also be a single event such as a horserace which has more than two possible competing parties (e.g., a horserace can have eight or more horses with only one winner that comes in first place). A series can also be predicated on current and political events, such as a presidential election (e.g., which candidate wins) or the winner of an academy award.

In one embodiment, the wager can be made before the series even begins. This means before a first game in the series begins.

FIG. 1 is a flowchart illustrating an exemplary method of implementing a wagering paradigm before a series has begun, according to an embodiment.

The method begins with operation 100, which receives a wager amount from a player. In one embodiment, the player can make the wager by going into a sports book and indicate to a casino employee how much he/she wishes to wager and on and on what series. The player can pay with cash (or other form of payment such as credit, electronic payment, etc.) and can receive a slip (also known as voucher or ticket) which evidences the wager (has the series, the pick and the amount on it). When the player indicates his or her desired wager and series to bet on, the casino employee could enter the wager amount and series into a computer (e.g., using a keyboard, etc.)

From operation 100, the method proceeds to operation 101, wherein the computer determines a pick which is a random potential outcome. This is done by taking all of the potential outcomes (e.g., all of the teams entered in the series that can win) and choosing one purely at random. Picking random numbers electronically is well known in the art. Because the random potential outcome is picked randomly, their distribution should typically have a random distribution, but of course since random numbers are unpredictable this may not be what actually happens. For example, if 10,000 made this wager and there are 25 possible winning teams, all 25 teams should approximately have the same number of picks (be picked the same number of times), but it is still possible that one team may be picked a disproportionately higher number of times than another (e.g., one team can be picked 5,000 times while another team can be picked 0 times).

In another embodiment, instead of picking the pick using a computer, a mechanical device can be used to determine the pick. For example, all 25 possible winning teams can be placed on a mechanical wheel (similar to a 'Big 6' wheel), each team with an equal chance of winning. The wheel can be spun and when the wheel stops, the team that is under the marker is the random team picked. The casino employee can then enter the pick into the computer system so a record is made of the mechanical pick. In addition to using a mechanical wheel, any other mechanical mechanism to pick a random outcome can be used as well, for example a die (with each side having a different team or outcome), cards (with each card having a different outcome and a random card is chosen), etc. Using a mechanical method to pick the pick has the advantage that the player knows that the pick is being picked purely randomly (while the outcome picked would also be purely random if a computer picks (as described above), players are sometimes suspicious of electronic random number generators.)

From operation 101, the method proceeds to operation 102, which provides the entry to the player. This can be in the form of a paper slip that can also have a barcode and/or an identification number so that it can be easily identified when presented to the sports book so it can be automatically identified and the computer can determine whether it is a winner (and if so, the payout) or not (in operation 105). The player can see which team was picked and typically the player would likely be happy or unhappy with the random potential outcome.

In one embodiment, the player can be presented with one opportunity to exchange the pick (the random potential outcome) given to him for another one. If the player declines this opportunity, then the pick provided to him is permanent. If the player accepts this opportunity, the player can surrender the current pick (the random potential outcome) given to him and receive a new pick (random potential outcome) which the player would then be stuck with. In this embodiment (where the player can have the opportunity to exchange a single pick), the payout would have to be reduced (over the embodiment where the player would not have the opportunity to exchange a single pick), in order to maintain a house edge (typically the house/casino should have a mathematical over all such wagers so that the house/casino can make money in the long run). Thus, the player would have one opportunity to try to improve the pick he was given, but of course if he chooses to receive a replacement pick it is possible the player would receive a worse pick (unless of course the original pick the player received was (in the player's mind) the worst possible pick). Since the picks are determined randomly, then if the player chooses to surrender the first pick given to him and receive a replacement pick the replacement pick could potentially be the same pick as the original one. Note that the word "pick" as used herein generally refers to the random potential outcome, but pick can also include other information as well in addition to the random potential outcome (e.g., a pick can comprise a winning team and also a point total that the team must have received in a game in order to be a winning pick). For example, a game can have an assigned over/under value before the game starts (generally a prediction of what the combined score of both teams will be which can be determined by the house), and a pick for a single game can be one (out of the two teams) and either over or under. The pick will win if the picked team wins the game and if the pick included over then if the combined score of both teams is over the over/under value. The pick will win if the picked team wins the game and if the pick included under then if the combined score of both teams is under the over/under value. The pick will lose if the picked team loses the game. The pick will lose if the pick includes over and the combined score of both teams is under the over/under value. The pick will lose if the pick includes under and the combined score of both teams is over the over/under value.

In addition to making the wager at a sports book, a player can also make the wager in other avenues as well. For example, the wager can be placed online at an online casino or online sports book. The wager can also be placed at a video lottery terminal, electronic gaming machine, etc. located inside or outside of a casino. In this case, the entry is not a physical slip (as in the sport book case) but can be in the form of an electronic communication (e.g., an email, digital confirmation of the wager on an LCD, etc.)

From operation 102, the method proceeds to operation 103, wherein the series begins. Of course the player (and the sports book) is merely "passive" in this activity as the series is typically held by outside actors (e.g., the teams, etc.)

From operation 103, the method proceeds to operation 104, wherein the series is completed and ends, and the actual outcome of the series (the winning outcome) is now known. This is also a passive activity on the part of the player and the party receiving the wager. In rare situations, a series may not have an outright winner (e.g., a horserace may end in a dead heat), and one way this situation could be addressed is if all action taken on the series for this wager is refunded to players.

When the series is completed, of course players will know whether their entry is a winner or not. The player can present his entry for redemption (e.g., bring his slip into the casino sports book).

From operation 104, the method proceeds to operation 105, which determines if the entry wins. If the random potential outcome determined in operation 101 does not match the actual outcome of the series (from operation 104), then the method proceeds to operation 107, in which the entry does not receive an award because the pick associated with the entry did not win the series. In this case, the player receives nothing for his entry (the player/entry loses).

If in operation 105, it is determined that the random potential outcome determined in operation 101 does match the actual outcome of the series (from operation 104), then the method proceeds to operation 106 and an award for the entry is computed and awarded to the player.

The award can be computed in numerous ways. In one embodiment, the payouts for all potential outcomes can be equal. For example, of 20 potential outcomes (e.g., 20 teams in a series), each winning team will pay 18:1 (18 times the initial wager amount from operation 100). Thus, if the player initially wagers $1 and wins (e.g., the player's entry is associated with a pick (random potential outcome) that matches the actual outcome of the series, then the player can exchange his/her slip at the sports book for $19 in cash. In this embodiment, the player would typically know before placing the wager what the payouts would be (regardless of which team is picked for his/her entry (e.g., the entry's random potential outcome) since all of the payouts would be equal for all different teams. In another embodiment, different random potential outcomes can have different payouts associated with them (e.g., when betting on the World Series one particular team may pay 30:1 and another team may pay 31:1), the payout for the particular entry should be indicated on the entry itself (e.g., the slip, digital display, etc.) This type of equal payout structure is illustrated in Table I.

TABLE I

| Team | Payout |
|---|---|
| A | 6:1 |
| B | 6:1 |
| C | 6:1 |
| D | 6:1 |
| E | 6:1 |
| F | 6:1 |
| G | 6:1 |
| H | 6:1 |

There are eight potential outcomes (teams) and each pays the same (6:1). Of course, in reality, some teams would be more favored than others so if a player is fortunate enough to receive a pick for his entry of one of the more favored teams the player should be happy. It is noted that with the paradigm illustrated in Table I with a randomly picked team (or outcome), a professional gambler could not beat this game because the team is picked randomly. This is in contrast to the standard sports book methodology in which professional gamblers are known to be able to beat the house by making skilled picks as to outcomes of games.

In another embodiment, the payout for each team would be the same as payouts on the team winning the same series before the series begins. Typically, sports books (and other betting establishments) commonly offer proposition wagers wherein different teams have different payouts to win the series based on their probability (or perceived probability) of actually winning the series. Table II represents one possible payout structure.

TABLE II

| Team | Payout |
|---|---|
| A | 2:1 |
| B | 1:2 |
| C | 4:1 |
| D | 10:1 |
| E | 40:1 |
| F | 8:1 |
| G | 8:1 |
| H | 6:1 |

Thus, in Table II, if a player places a wager before the series starts that team C will win, this will pay 4:1 (4 times the original wager amount). This is a type of proposition wager commonly offered in sports books. However, once the series begins, this exact payout list can no longer be used because there is new information known. For example, if team E wins the first game of the series (a series may be any number of games such as 20, 100, or more), then the payout for team E to win the overall series should go down (because team E may be doing better than people original predicted). It is also common in a series that some teams can no longer even win the series (because they have lost too many games to proceed into the series' finals) and thus there would be no payouts for those teams to win the series. The list of payouts in Table II (or Table I) can be displayed to the player at a sports book (or online casino, video terminal, etc.) so that the player would know what the odds can be before placing the wager.

Thus, the payout on a wager made on a random pick (random potential outcome) as described herein can be selected from the set of payouts for the series winner before the series has begun (these payouts would be preserved by the sports book). So for example, if in the middle of a series, a player makes a $10 wager on a random pick, and the random pick given to the player is team D, then the player would receive a payout of 10:1 (10 times $10 or $100) if team D wins the series. It might be that team D happens to be doing very well in the series in which the player would be happy (because 10:1 is a relatively high payout in Table II). On the other hand, if team D is doing very poorly in the series and in fact it is not even possible for team D to win, then the player has already lost as it would be impossible for this entry to win.

In a further embodiment, only teams that are still capable of winning the series would be included in the potential outcomes (in operation 202). In this way, it would not be possible for a random potential outcome to be determined (in operation 101) that would be incapable of winning the series. Of course, payout odds would have to be adjusted in this embodiment to reflect the ineligibility of certain teams. For example, if the payout structure in Table I is used but teams A and B can no longer win the series, then only teams (C, D, E, F, G, H) are potential outcomes and can be picked as potential random outcomes, but the payout odds in Table I would have to reduced (for example instead of 6:1 payouts the payouts now would be 4:1).

The methods described herein can be applied regardless of the point in time in relation to the series (e.g., the wager can be taken from the player before the series begins, after the series has begun, or even after the series is over).

The methods described herein can also be applied to any proposition wager. For example, a proposition can be for a given night in a season, the team which scores the most points in that night. If a team does not play on that night then they would get 0 points. Thus, a random team can be picked (as described herein) and if that team scores the most points in that night then the wager wins otherwise the wager loses.

In a further embodiment, before the player receives the pick with the random potential outcome (in operations 101 or 202), the player can indicate a single team to be removed from the possible potential outcomes. For example, in Table I, if the player wishes to remove team D from the possible outcomes the player can do so and the random pick provided to the player would never include team D. Since this reduces the number of possible teams, the payout of having a winning ticket would be reduced as well. For example, if in Table I, each team pays 6:1 if it wins, by removing a single team then each remaining team would pay 5:1 if it wins (of course other payouts can be used as well). If the removed team ends up winning, the player would get their money back for the original wager (e.g., a push). Thus, for example, if the player made a $1 wager and decided to remove D, and received team C as the random pick, and team D actually won the proposition, then the player would receive his/her $1 back. If team C won the proposition, then the player would win $5 (5:1). If team A won the proposition, then the player wins nothing (the player loses the purchase price of the ticket). In a further embodiment, a player would be permitted to remove more than just one team from the potential outcomes, but of course for each team removed the payouts would have to be adjusted accordingly. Thus, for example if a player wished to remove two teams, then the payouts in Table I would go down to 4:1 for each remaining team and if either of the two removed teams wins the proposition the player would get his/her money back for the wager/ticket. The player can remove any number of teams in this manner (but of course at least two teams have to remain).

Figure 2:
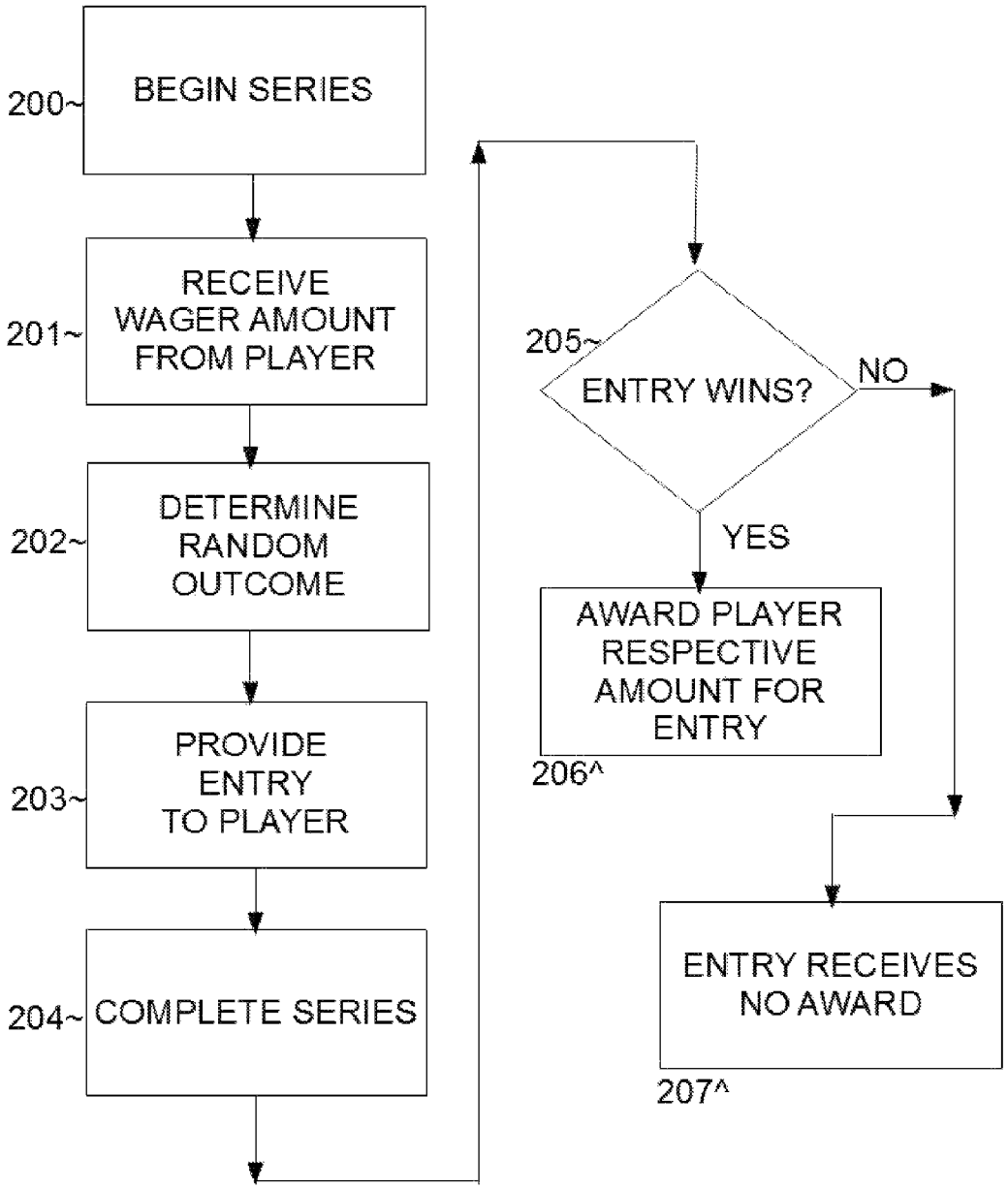
FIG. 2 is a flowchart illustrating an exemplary method of implementing a wagering paradigm after a series has begun, according to an embodiment.

FIG. 2 is a flowchart illustrating an exemplary method of implementing a wagering paradigm after a series has begun, according to an embodiment.

FIG. 2 is similar to FIG. 1, but in FIG. 2 the wager is received from the player (operation 201) after the series has begun (operation 200). Thus, in operation 200, the series has already begun (e.g., the first game in the series has already started, or the first game in the series has reached a predetermined point (e.g., half-time), the first game in the series is over, etc.) Thus, at this point, there is additional information available than at the beginning of the series. Operation 201 can be performed at any time, even after the series is over.

The operations in FIG. 2 are performed as described in FIG. 1 (e.g., 200 is 103, 201 is 100, 202 is 101, 203 is 102, 204 is 104, 205 is 105, 206 is 106, and 207 is 107).

FIG. 3A is a drawing illustrating an example paper entry, according to an embodiment.

A paper entry 300 contains all relevant information about the wager (it may or may not contain the player's name if this information is known to the sports book). A paper entry can be printed in a printer hooked up to a computer system used by the sports book, and an electronic record would also be maintained of the entry. In this entry 300, the random team chosen by the computer is the METS, the series is the World Series, the player paid $100 to make the wager, the player would be paid $3,000 if the METS win the World Series, and the date the wager was made is Aug. 4, 2012. The ticket also has a barcode in the bottom left so that the ticket can be scanned and a record associated with the ticket (entry) can be automatically retrieved. In this way, the computer system can automatically scan a ticket and determine if it is a winner or not (and if so, how much to pay the player). Winning tickets are typically paid immediately to players in cash. A ticket number is also printed on the ticket in order to locate the ticket in the database (in case for some reason the barcode is not used).

FIG. 3B is a drawing illustrating an example of a computer entry, according to an embodiment.

If the player makes the wager online, then an entry can be the confirmation screen (or any other electronic communication identifying the wager details) which can be displayed on an electronic output device (e.g., LCD screen, etc.) The information in the electronic entry 301 is the same as illustrated in the paper entry 300. This information can also be presented to the player in an email, text message, etc.

Figure 4:
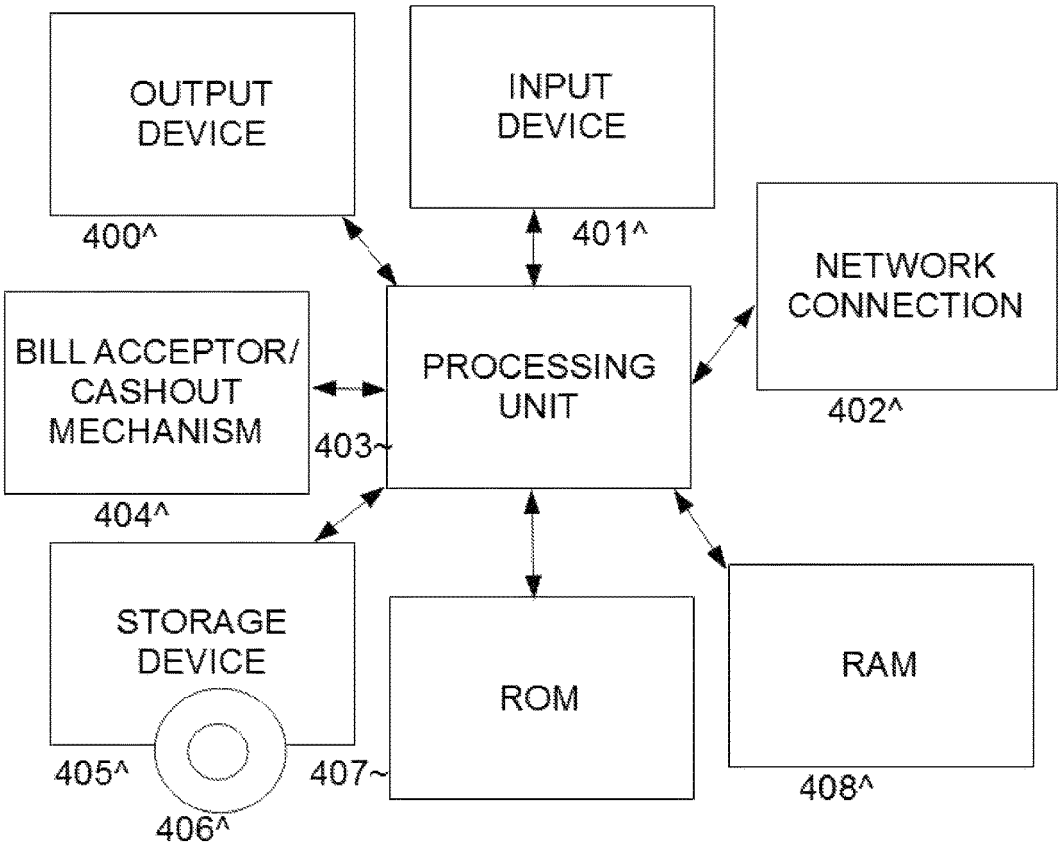
FIG. 4 is a block diagram illustrating a sample physical hardware configuration that can be used to implement the methods described herein (such as a video lottery terminal, electronic gaming machine, etc.), according to an embodiment.

FIG. 4 is a block diagram illustrating a sample physical hardware configuration that can be used to implement the methods described herein (such as a video lottery terminal, electronic gaming machine, etc.), according to an embodiment. This structure can also be used to implement any computer, server, database, etc., that is part of a system to implement the methods described herein.

A processing unit 403 can be a microprocessor and associated structure (bus, cache, etc.) The processing unit is capable of executing programmed instructions which are pre-coded and stored (in the ROM 407, RAM 408, or storage medium 406, or other source) that will implement all of the methods described herein (including picking the random outcome in operations 101/202). The processing unit is connected to an output device 400 (e.g., LCD, speaker, touch-screen, etc.), an input device 401 (keyboard, touch-screen, mouse, buttons, etc.), and a network connection 402 (e.g. a connection to a WAN, LAN, Internet, etc.) The processing unit is also connected to a ROM 407, a RAM 408, and a storage device 405 (e.g., CD-ROM, DVD, hard disk, EPROM, or any other storage device). A computer readable storage medium 406 can be read by the storage device 405 and can store programs to implement all of the methods described herein. The processing unit 403 is also connected to a bill acceptor/cashout mechanism 404 (if needed), which can receive cash deposits or tickets from the player to credit the player's credit mater and can also make payments to the player when the player cashes out by issuing physical coins or a ticket redeemable for cash. Cashing out can also be accomplished playing an online version using an electronic payment mechanism (electronic funds transfer) or by sending a physical payment (e.g., check) to the player.

Figure 5A:
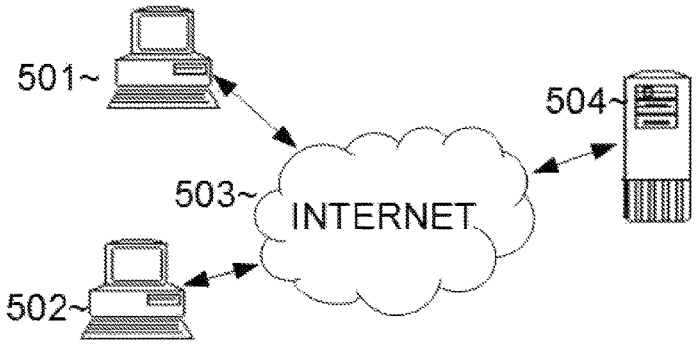
FIG. 5A is a block diagram illustrating a configuration for an online casino, according to an embodiment.

FIG. 5A is a block diagram illustrating a configuration for an online casino, according to an embodiment.

An online casino server 504 hosts/serves an online casino using a computer communications network such as the internet 503. Player computers 501, 502 can connect to the online casino server 504 over the Internet so that their respective players can play at the online casino which can receive wagers as described herein.

Figure 5B:
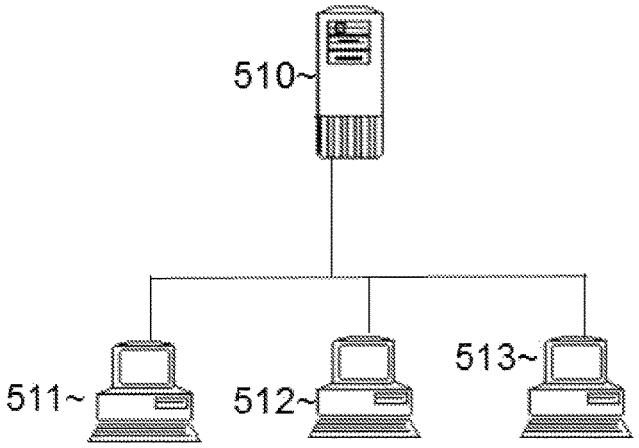
FIG. 5B is a block diagram illustrating a configuration for a sports book network, according to an embodiment.

FIG. 5B is a block diagram illustrating a configuration for a sports book network, according to an embodiment.

In a physical sports book (which can accept any wager described herein), a database 510 (e.g., an SQL or any other type of database) is used to store electronic records of all wagers made and all of their respective information. In this manner, when an entry is presented for redemption, the database 510 can retrieve the entry's respective record and determine whether it is a winner or not (the database 510 would also know who the actual winners are of all series served). Terminals 511, 512, 513 are connected to the database 510 using a computer communications network. Casino employees can be stationed at each terminal and can receive each player's desired wager information (e.g., wager amount, series or game (that the proposition is based on), eliminated teams (if any), and any other information described herein or needed to make the wager/transaction) and enter (e.g., type on a keyboard) all of this information into their terminals so all of this information can be stored in the database 510. The database 510 can be configured to perform all of the methods described herein including determining the pick (random potential outcome), store and transmit this information to each respective terminal. The database 510 is programmed to store all needed information about each wager (entry) and would typically maintain the data indefinitely. The database 510 would typically be secure and could not be accessed by unauthorized personnel in order to keep all of the wager data intact. Each entry would typically have a record in the database 510 that can be retrieved by the database 510, the terminals, or any other component on the network that is supposed to have access to the database 510. Not pictured are a barcode scanner (to scan barcodes on each paper entry to determine if they are winners) and a printer (to print paper entries) at each terminal.

The methods described herein are intended to be played in legal establishments which can allow the player to wager credits which are directly redeemable for real money (cash or coin).

It is also noted that any and/or all of the above embodiments, configurations, variations of the present invention described above can mixed and matched and used in any combination with one another. Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

The invention claimed is:

1. A method for wagering on a series, the method comprising:

executing instructions on an electronic processing unit, the instructions being read from a non-transitory computer readable storage medium, the instructions causing the electronic processing unit to perform:

at a time after at least one game in a series has been played but before the series is completed, the series comprising a set of at least two games and at least two teams, a winner of the series being one of the at least two teams determined based on predefined rules after the set of at least two games has been completed, performing:

receiving a wager amount from a player on the series;

determining, a set of possible teams that are still capable of winning the series at the time by eliminating teams that can no longer win the series at the time and determining a pick which cannot be exchanged by the player comprising a random potential outcome of the series out of the set of possible teams and storing a record of the pick in an electronic database;

issuing the player an entry that wins when the winner of the series matches the random potential outcome;

after the series is completed, determining that the winner of the series matches the random potential outcome; and paying the player a payout based on the entry.

2. The method as recited in claim 1, wherein the payout is a same payout that the random potential outcome paid on a standard proposition wager before the series began, different random potential outcomes having different payouts.

3. The method as recited in claim 1, wherein the payout is based on a number of possible random potential outcomes, each random potential outcome having an identical payout.

4. The method as recited in claim 1, wherein the payout remains static throughout the series.

5. The method as recited in claim 1, wherein the payout changes throughout the series.

6. The method as recited in claim 1, wherein before the determining the pick, receiving a selection from the player of an eliminated team, wherein the eliminated team would not have the potential to be the pick, and reducing the payout to reflect the eliminated team.

* * * * *